US011377985B2

(12) United States Patent
Cecil et al.

(10) Patent No.: US 11,377,985 B2
(45) Date of Patent: Jul. 5, 2022

(54) SWITCHING TAPPET OR A ROLLER FINGER FOLLOWER FOR COMPRESSION RELEASE BRAKING

(71) Applicant: Cummins Inc., Columbus, IN (US)

(72) Inventors: Adam C. Cecil, Columbus, IN (US); Anshul Shambhav, Glenview, IL (US); Anthony Kyle Perfetto, Columbus, IN (US)

(73) Assignee: Cummins Inc., Columbus, IN (US)

( * ) Notice: Subject to any disclaimer, the term of this patent is extended or adjusted under 35 U.S.C. 154(b) by 197 days.

(21) Appl. No.: 16/815,444

(22) Filed: Mar. 11, 2020

(65) Prior Publication Data

US 2020/0208547 A1 Jul. 2, 2020

Related U.S. Application Data

(63) Continuation of application No. PCT/US2018/049370, filed on Sep. 4, 2018.
(Continued)

(51) Int. Cl.
*F01L 13/06* (2006.01)
*F01L 1/14* (2006.01)
(Continued)

(52) U.S. Cl.
CPC ..... *F01L 13/065* (2013.01); *F01L 1/143* (2013.01); *F01L 1/25* (2013.01); *F01L 13/0036* (2013.01);
(Continued)

(58) Field of Classification Search
CPC ..... F01L 1/053; F01L 1/143; F01L 2001/186; F01L 1/25; F01L 1/344; F01L 13/0036;
(Continued)

(56) References Cited

U.S. PATENT DOCUMENTS 5,555,861 A * 9/1996 Mayr ..... F01L 1/143 123/198 F
5,694,894 A 12/1997 Allen
(Continued)

OTHER PUBLICATIONS

International Search Report; International Searching Authority; International Application No. PCT/US2018/049370; dated Nov. 15, 2018; 2 pages.
(Continued)

*Primary Examiner* — Jorge L Leon, Jr.

(74) *Attorney, Agent, or Firm* — Taft Stettinius & Hollister LLP

(57) ABSTRACT

A system includes an engine with a plurality of pistons housed in respective ones of a plurality of cylinders, an air intake system provides air to the plurality of cylinders through respective ones of a plurality of intake valves, an exhaust system to release exhaust gas from the plurality of cylinders through one of a plurality of exhaust valves, and a controller coupled to a sensor to control a switching tappet for compression release braking. Alternatively to a tappet, the system includes a roller finger follower controlling an opening and closing timing of exhaust valves, the roller finger follower has an inner roller follower arm adjacent an outer sliding follower, and a controller that in response to an engine braking request locks the inner roller follower arm with the outer sliding follower to contact a second cam lobe and open the exhaust valve during a compression stroke of the cylinder.

19 Claims, 9 Drawing Sheets

Related U.S. Application Data

(60) Provisional application No. 62/561,771, filed on Sep. 22, 2017.

(51) Int. Cl.

| | |
|---|---|
| ***F01L 13/00*** | (2006.01) |
| ***F01L 1/25*** | (2006.01) |
| ***F02D 13/02*** | (2006.01) |
| ***F02D 13/04*** | (2006.01) |
| *F01L 1/18* | (2006.01) |
| *F01L 1/053* | (2006.01) |
| *F01N 3/00* | (2006.01) |
| *F01L 1/344* | (2006.01) |

(52) U.S. Cl.
CPC ..... *F02D 13/0246* (2013.01); *F02D 13/04* (2013.01); *F01L 1/053* (2013.01); *F01L 1/344* (2013.01); *F01L 2001/186* (2013.01); *F01N 3/00* (2013.01)

(58) Field of Classification Search
CPC ..... F01L 13/06; F01L 13/065; F01N 3/00; F02D 13/0246; F02D 13/04
USPC ..... 123/90.16, 90.27, 90.41, 90.44, 90.48; 60/280, 299
See application file for complete search history.

(56) References Cited

U.S. PATENT DOCUMENTS 5,718,199 A * 2/1998 Hu ..... F01L 13/06 123/322
5,950,583 A * 9/1999 Kraxner ..... F01L 13/0036 123/90.16
6,647,954 B2 * 11/2003 Yang ..... F01L 13/06 123/321
6,694,933 B1 * 2/2004 Lester ..... F01L 13/06 123/90.12
8,807,101 B2 8/2014 Choi et al.
9,039,571 B2 5/2015 Doering et al.
9,581,058 B2 2/2017 Radulescu et al.
2007/0157901 A1 * 7/2007 Caine ..... F02B 17/005 123/302
2007/0240653 A1 * 10/2007 Petridis ..... F02D 13/06 123/90.16
2009/0145379 A1 * 6/2009 Cho ..... F01L 1/26 123/90.6
2009/0145383 A1 * 6/2009 Baek ..... F01L 1/143 123/90.16
2009/0173296 A1 * 7/2009 O'Neill ..... F01L 1/143 123/90.16
2010/0059015 A1 * 3/2010 Surnilla ..... F02D 13/0257 123/295
2011/0272612 A1 11/2011 Choi et al.
2012/0060783 A1 3/2012 Woo et al.
2014/0261310 A1 * 9/2014 Troisi ..... F02D 9/06 123/324
2015/0101554 A1 * 4/2015 Lee ..... F01L 1/344 123/90.17
2016/0201587 A1 * 7/2016 Nagaoka ..... F01N 3/0814 60/299
2017/0175652 A1 6/2017 Ronnqvist et al.
2019/0376420 A1 * 12/2019 Elendt ..... F01L 13/0005

OTHER PUBLICATIONS

Written Opinion of the International Searching Authority; International Searching Authority; International Application No. PCT/US2018/049370; dated Nov. 15, 2018; 9 pages.
International Preliminary Report on Patentability; International Searching Authority; International Application No. PCT/US2018/049370; dated Apr. 2, 2020; 10 pages.

* cited by examiner

SWITCHING TAPPET OR A ROLLER FINGER FOLLOWER FOR COMPRESSION RELEASE BRAKING

CROSS-REFERENCE TO RELATED APPLICATION

The present application is a continuation of International Patent Application No. PCT/US18/49370 filed on Sep. 4, 2018, claims the benefit of the filing date of U.S. Provisional Application No. 62/561,771 filed on Sep. 22, 2017, which is incorporated herein by reference.

BACKGROUND

The present invention relates to operation of an internal combustion engine system, and more particularly, but not exclusively, relates to a switching tappet and a roller finger follower for compression release braking of an internal combustion engine.

Various engine braking systems have been developed to provide compression release braking of an internal combustion engine. One form of an engine braking system is a compression release engine brake. When the compression release engine brake is activated, it opens exhaust valves in the cylinders after the compression cycle, releasing the compressed air trapped in the cylinders, and slowing the vehicle. However, a compression release engine brake is sensitive and often hard to implement, maintain, or install properly. Moreover, compression release engine brakes are expensive.

However, further contributions in this area of technology are needed to provide improved compression release braking and control for certain types of valvetrains. Further contributions are needed to provide improved compression release for a lower cost.

SUMMARY

Certain embodiments of the present application includes unique systems, methods and apparatus for operation of an internal combustion engine using an engine braking system for compression release braking. In a unique system, a switching tappet includes an inner tappet and an outer tappet that are selectively controlled to cooperate with inner and outer cam lobes for exhaust release (braking) during the exhaust stoke and compression release during the compression stroke. In another unique system, a roller finger follower is selectively controlled to cooperate with inner and outer cam lobes for exhaust release (braking) during the exhaust stoke and compression release during the compression stroke. Other embodiments include unique apparatus, devices, systems, and methods involving the control of an internal combustion engine system via an engine braking system to meet one or more of an engine braking request and a vehicle or engine speed request. Either of these embodiments can also be used for a compression release event. The compression release event can be changed to a compression brake event with a camshaft phaser to move the exhaust brake event to a power stroke rather than the compression stroke. Moreover, a default position of either valvetrain is to provide compression release event. No system response is required during cranking or starting of the engine. These systems are capable of compression braking when the exhaust event is positioned during the exhaust stroke to release gas and as a compression release when positioned on the compression stroke. When the gas release occurs on the power stroke there is a braking function. When the gas release occurs on the compression stroke there is a lower power starting situation.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION OF REPRESENTATIVE EMBODIMENTS

Figure 1:
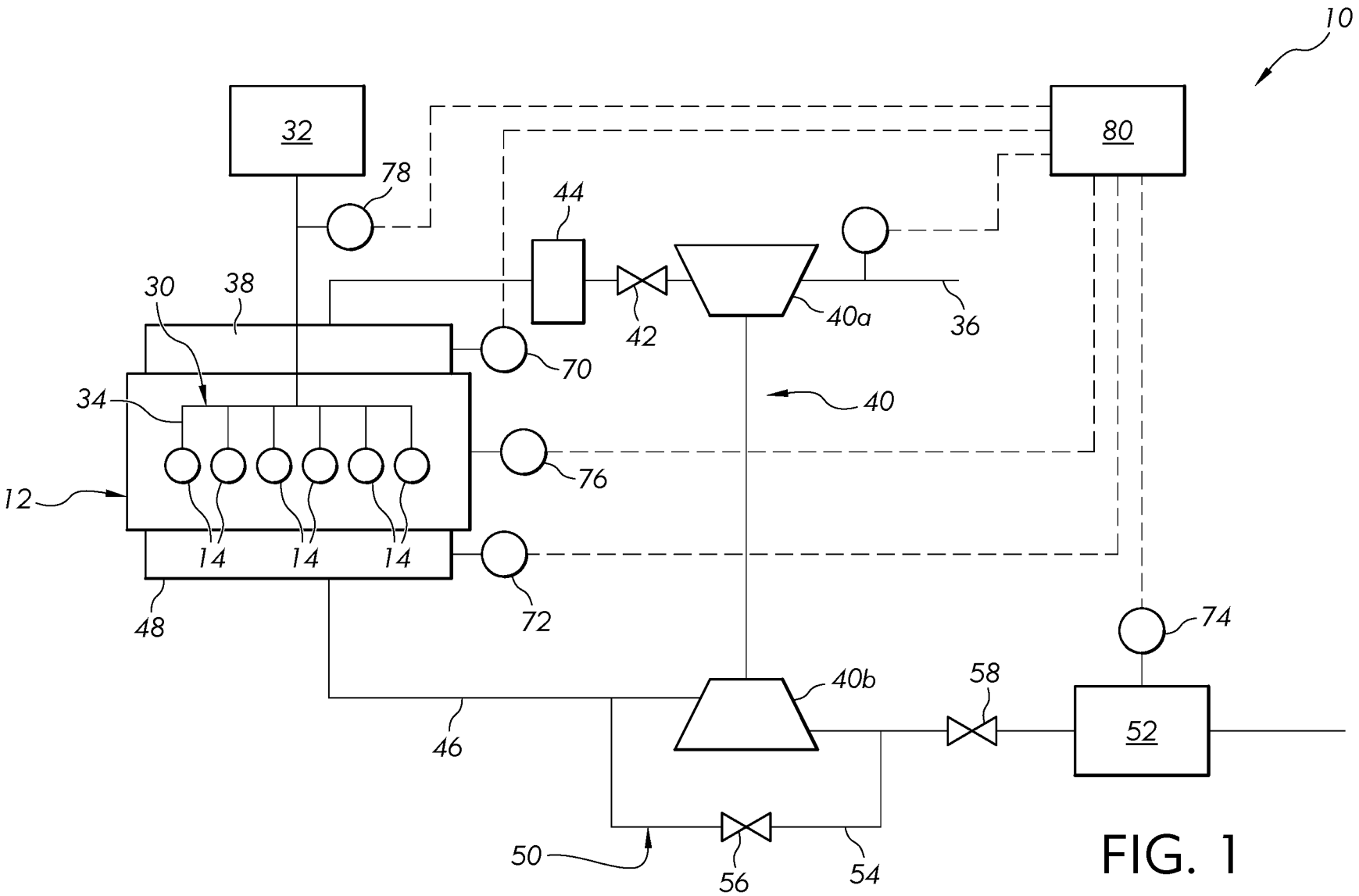
FIG. 1 is a schematic view of one embodiment of an internal combustion engine system operable to provide compression release braking.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein are contemplated as would normally occur to one skilled in the art to which the invention relates.

With reference to FIG. 1, an internal combustion engine system 10 includes a four-stroke internal combustion engine 12. FIG. 1 illustrates an embodiment where the engine 12 is a diesel engine, but any engine type is contemplated, including compression ignition, spark-ignition, and combinations of these. The engine 12 can include a plurality of cylinders 14. FIG. 1 illustrates the plurality of cylinders 14 in an arrangement that includes six cylinders 14 in an in-line arrangement for illustration purposes only. Any number of cylinders and any arrangement of the cylinders suitable for use in an internal combustion engine can be utilized. The number of cylinders 14 that can be used can range from one cylinder to eighteen or more. Furthermore, the following description at times will be in reference to one of the cylinders 14. It is to be realized that corresponding features in reference to the cylinder 14 described in FIG. 2 and at other locations herein can be present for all or a subset of the other cylinders 14 of engine 12.

Figure 2:
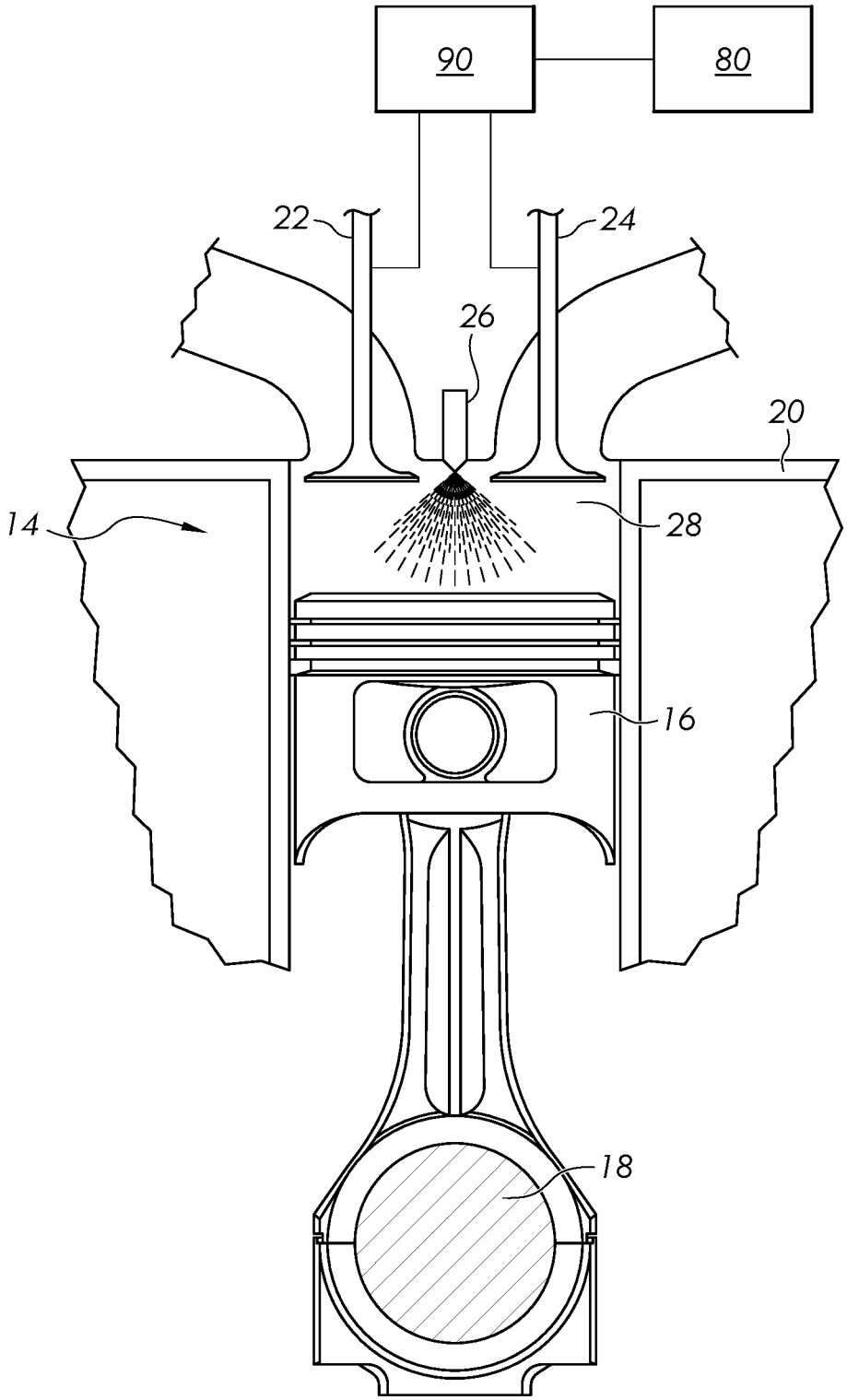
FIG. 2 is a diagrammatic and schematic view of one embodiment of a cylinder of the internal combustion engine system of FIG. 1 and a schematic of a valve actuation mechanism.

As shown in FIG. 2, the cylinder 14 houses a piston 16 that is operably attached to a crankshaft 18 that is rotated by reciprocal movement of piston 16 in a combustion chamber 28 of the cylinder 14. Within a cylinder head 20 of the cylinder 14, there is at least one intake valve 22, at least one exhaust valve 24, and a fuel injector 26 that provides fuel to the combustion chamber 28 formed by cylinder 14 between the piston 16 and the cylinder head 20. In other embodiments, fuel can be provided to combustion chamber 28 by port injection, or by injection in the intake system, upstream of combustion chamber 28.

The term "four-stroke" herein means the following four strokes—intake, compression, power, and exhaust—that the piston 16 completes during two separate revolutions of the engine's crankshaft 18. A stroke begins either at a top dead center (TDC) when the piston 16 is at the top of cylinder head 20 of the cylinder 14, or at a bottom dead center (BDC), when the piston 16 has reached its lowest point in the cylinder 14.

During the intake stroke, the piston 16 descends away from cylinder head 20 of the cylinder 14 to a bottom (not shown) of the cylinder, thereby reducing the pressure in the combustion chamber 28 of the cylinder 14. In the instance where the engine 12 is a diesel engine, a combustion charge is created in the combustion chamber 28 by an intake of air through the intake valve 22 when the intake valve 22 is opened.

The fuel from the fuel injector 26 is supplied by a high pressure common-rail system 30 (FIG. 1) that is connected to the fuel tank 32. Fuel from the fuel tank 32 is suctioned by a fuel pump (not shown) and fed to the common-rail fuel system 30. The fuel fed from the fuel pump is accumulated in the common-rail fuel system 30, and the accumulated fuel is supplied to the fuel injector 26 of each cylinder 14 through a fuel line 34. The accumulated fuel in common rail system can be pressurized to boost and control the fuel pressure of the fuel delivered to combustion chamber 28 of each cylinder 14.

During the compression stroke in a non-engine braking mode of operation, both the intake valve 22 and the exhaust valve 24 are closed. The piston 16 returns toward TDC and fuel is injected near TDC in the compressed air in a main injection event, and the compressed fuel-air mixture ignites in the combustion chamber 28 after a short delay. In the instance where the engine 12 is a diesel engine, this results in the combustion charge being ignited. The ignition of the air and fuel causes a rapid increase in pressure in the combustion chamber 28, which is applied to the piston 16 during its power stroke toward the BDC. Combustion phasing in combustion chamber 28 is calibrated so that the increase in pressure in combustion chamber 28 pushes piston 16, providing a net positive in the force/work/power of piston 16.

During the exhaust stroke, the piston 16 is returned toward TDC while the exhaust valve 24 is open. This action discharges the burnt products of the combustion of the fuel in the combustion chamber 28 and expels the spent fuel-air mixture (exhaust gas) out through the exhaust valve 24.

The intake air flows through an intake passage 36 and intake manifold 38 before reaching the intake valve 22. The intake passage 36 may be connected to a compressor 40*a* of a turbocharger 40 and an optional intake air throttle 42. The intake air can be purified by an air cleaner (not shown), compressed by the compressor 40*a* and then aspirated into the combustion chamber 28 through the intake air throttle 42. The intake air throttle 42 can be controlled to influence the air flow into the cylinder. Embodiments without turbocharger 40 are also contemplated.

The intake passage 36 can be further provided with a cooler 44 that is provided downstream of the compressor 40*a*. In one example, the cooler 44 can be a charge air cooler (CAC). In this example, the compressor 40*a* can increase the temperature and pressure of the intake air, while the CAC 44 can increase a charge density and provide more air to the cylinders. In another example, the cooler 44 can be a low temperature aftercooler (LTA). The CAC 44 uses air as the cooling media, while the LTA uses coolant as the cooling media.

The exhaust gas flows out from the combustion chamber 28 into an exhaust passage 46 from an exhaust manifold 48 that connects the cylinders 14 to exhaust passage 46. The exhaust passage 46 is connected to a turbine 40*b* and a wastegate 50 of the turbocharger 40 and then into an aftertreatment system 52. The exhaust gas that is discharged from the combustion chamber 28 drives the turbine 40*b* to rotate. The wastegate 50 is a device that enables part of the exhaust gas to by-pass the turbine 40*b* through a passageway 54. Less exhaust gas energy is thereby available to the turbine 40*b*, leading to less power transfer to the compressor 40*a*. Typically, this leads to reduced intake air pressure rise across the compressor 40*a* and lower intake air density/flow. The wastegate 50 can include a control valve 56 that can be an open/closed (two position) type of valve, or a full authority valve allowing control over the amount of by-pass flow, or anything between. The exhaust passage 46 can further or alternatively include an exhaust throttle 58 for adjusting the flow of the exhaust gas through the exhaust passage 46. The exhaust gas, which can be a combination of by-passed and turbine flow, then enters the aftertreatment system 52.

Optionally, a part of the exhaust gas can be recirculated into the intake system via an EGR passage (not shown.) The EGR passage can be connected the exhaust passage upstream of the turbine 40*b* to the intake passage 36 downstream of the intake air throttle 42. Alternatively or additionally, a low pressure EGR system (not shown) can be provided downstream of turbine 40*b* and upstream of compressor 40*a*. An EGR valve can be provided for regulating the EGR flow through the EGR passage. The EGR passage can be further provided with an EGR cooler and a bypass around the EGR cooler.

The aftertreatment system 52 may include one or more devices useful for handling and/or removing material from exhaust gas that may be harmful constituents, including carbon monoxide, nitric oxide, nitrogen dioxide, hydrocarbons, and/or soot in the exhaust gas. In some examples, the aftertreatment system 52 can include at least one of a catalytic device and a particulate matter filter. The catalytic device can be a diesel oxidation catalyst (DOC) device, ammonia oxidation (AMOX) catalyst device, a selective catalytic reduction (SCR) device, three-way catalyst (TWC), lean NOX trap (LNT) etc. The reduction catalyst can include any suitable reduction catalysts, for example, a urea selective reduction catalyst. The particulate matter filter can be a diesel particulate filter (DPF), a partial flow particulate filter (PFF), etc. A PFF functions to capture the particulate matter in a portion of the flow; in contrast the entire exhaust gas volume passes through the particulate filter.

The arrangement of the components in the aftertreatment system 52 can be any arrangement that is suitable for use with the engine 12. For example, in one embodiment, a DOC and a DPF are provided upstream of a SCR device. In one example, a reductant delivery device is provided between the DPF and the SCR device for injecting a reductant into the exhaust gas upstream of SCR device. The reductant can be urea, diesel exhaust fluid, or any suitable reductant injected in liquid and/or gaseous form.

A controller 80 is provided to receive data as input from various sensors, and send command signals as output to various actuators. Some of the various sensors and actuators that may be employed are described in detail below. The controller 80 can include, for example, a processor, a memory, a clock, and an input/output (I/O) interface.

The system 10 may include various sensors such as an intake manifold pressure/temperature sensor 70, an exhaust manifold pressure/temperature sensor 72, one or more after-treatment sensors 74 (such as a differential pressure sensor, temperature sensor(s), pressure sensor(s), constituent sensor(s)), engine sensors 76 (which can detect the air/fuel ratio of the air/fuel mixture supplied to the combustion chamber, a crank angle, the rotation speed of the crankshaft, etc.), and a fuel sensor 78 to detect the fuel pressure and/or other properties of the fuel, common rail 38 and/or fuel injector 26. Any other sensors known in the art for an engine system are also contemplated.

System 10 can also include various actuators for opening and closing the intake valves 22, for opening and closing the exhaust valves 24, for injecting fuel from the fuel injector 26, for opening and closing the wastegate valve 56, for the intake air throttle 42, and/or for the exhaust throttle 58. The actuators are not illustrated in FIG. 1, but one skilled in the art would know how to implement the mechanism needed for each of the components to perform the intended function. Furthermore, in one embodiment, the actuators for opening and closing the intake and exhaust valves 22, 24 is a valve actuation (VA) system 90, such as a variable valve actuation mechanism.

Figure 3:
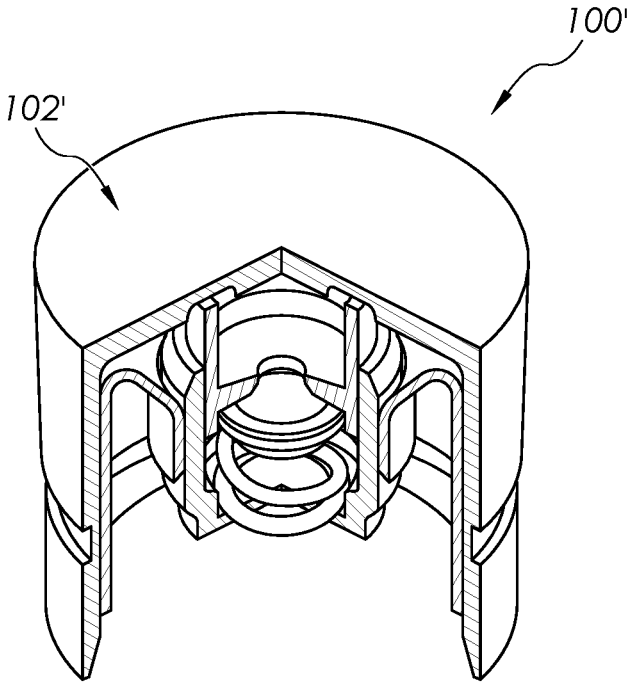
FIG. 3 (PRIOR ART)
FIG. 3 is a perspective view showing a prior art non-switching flat tappet part of a valve train of the internal combustion engine for intake or exhaust valve actuation.
Figure 4:
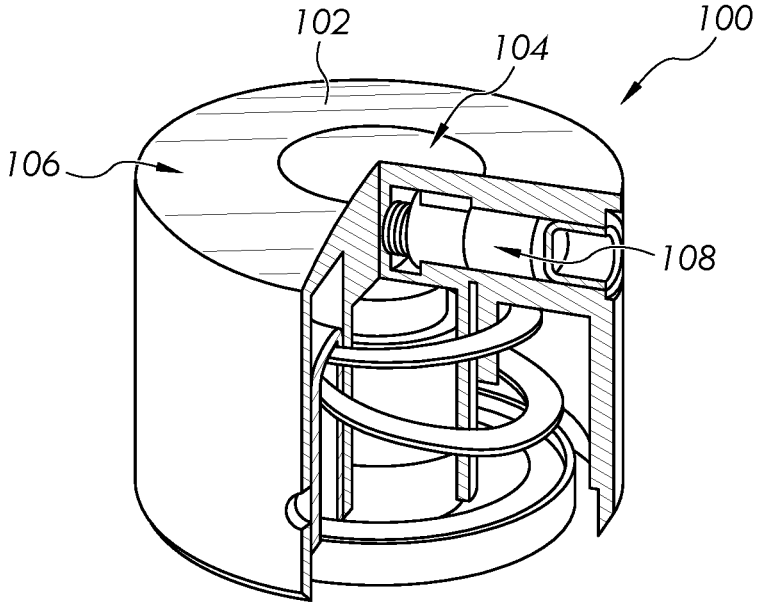
FIG. 4 is a perspective view in partial section of a switching tappet part of a valve train.

Referring to FIG. 3, there is shown a prior art non-switching type of tappet 100' that includes a flat upper surface 102'. In contrast, FIG. 4 provides further details regarding one embodiment of a switching tappet 100 for VA system 90 is shown that is applicable to compression release braking in conjunction with VA technology. Specifically, the VA system 90 includes compression release brake lobes that are coupled to one or more camshafts (not shown) that are in contact with or contactable with switching tappet 100. The VA system 90 can further include a phaser that adjusts a relative positioning and timing of the compression release brake lobes during engine braking operations. The switching tappet 100 is connected to an exhaust valve 24 so that the cam lobe or lobes acting on switching tappet 100 open and close the connected exhaust valve during rotation of the camshaft.

Figure 6A:
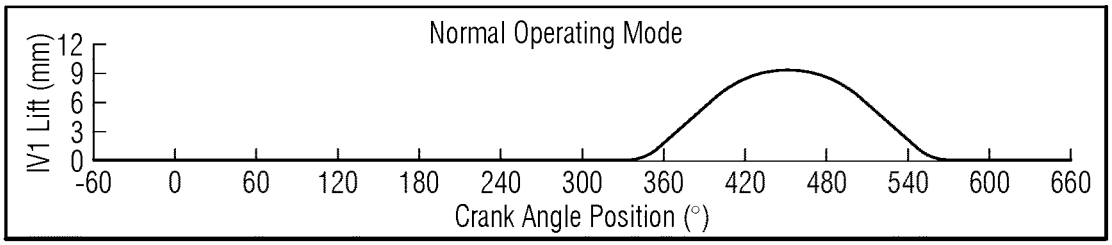
FIGS. 6A-6E are a series of graphs showing various intake and exhaust valve lift profiles during a normal (non-braking) mode and an exhaust valve lift during a braking mode.
Figure 6B:
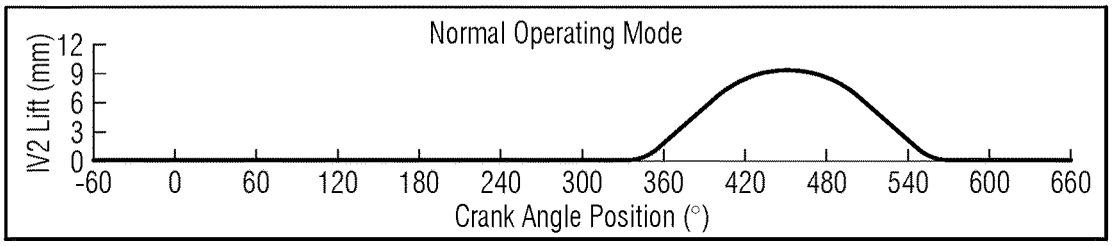
Figure 6C:
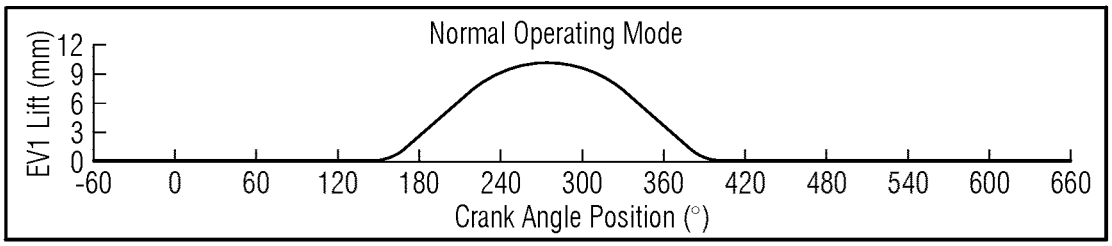
Figure 6D:
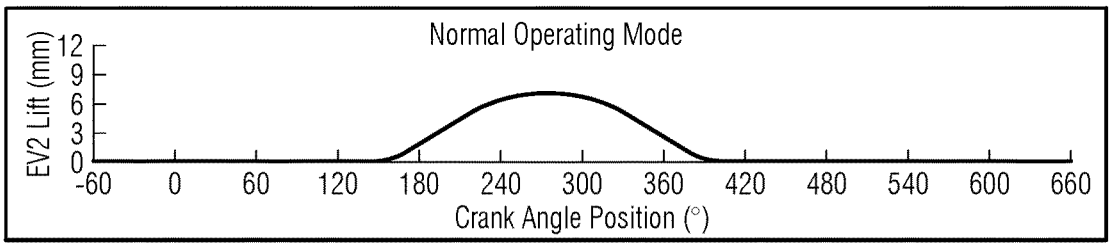
Figure 6E:
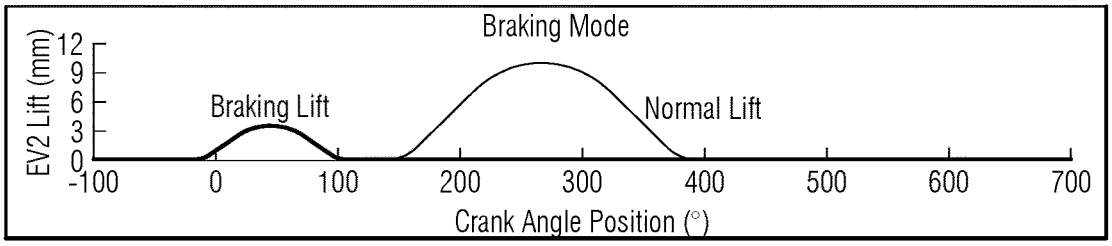
Figure 7:
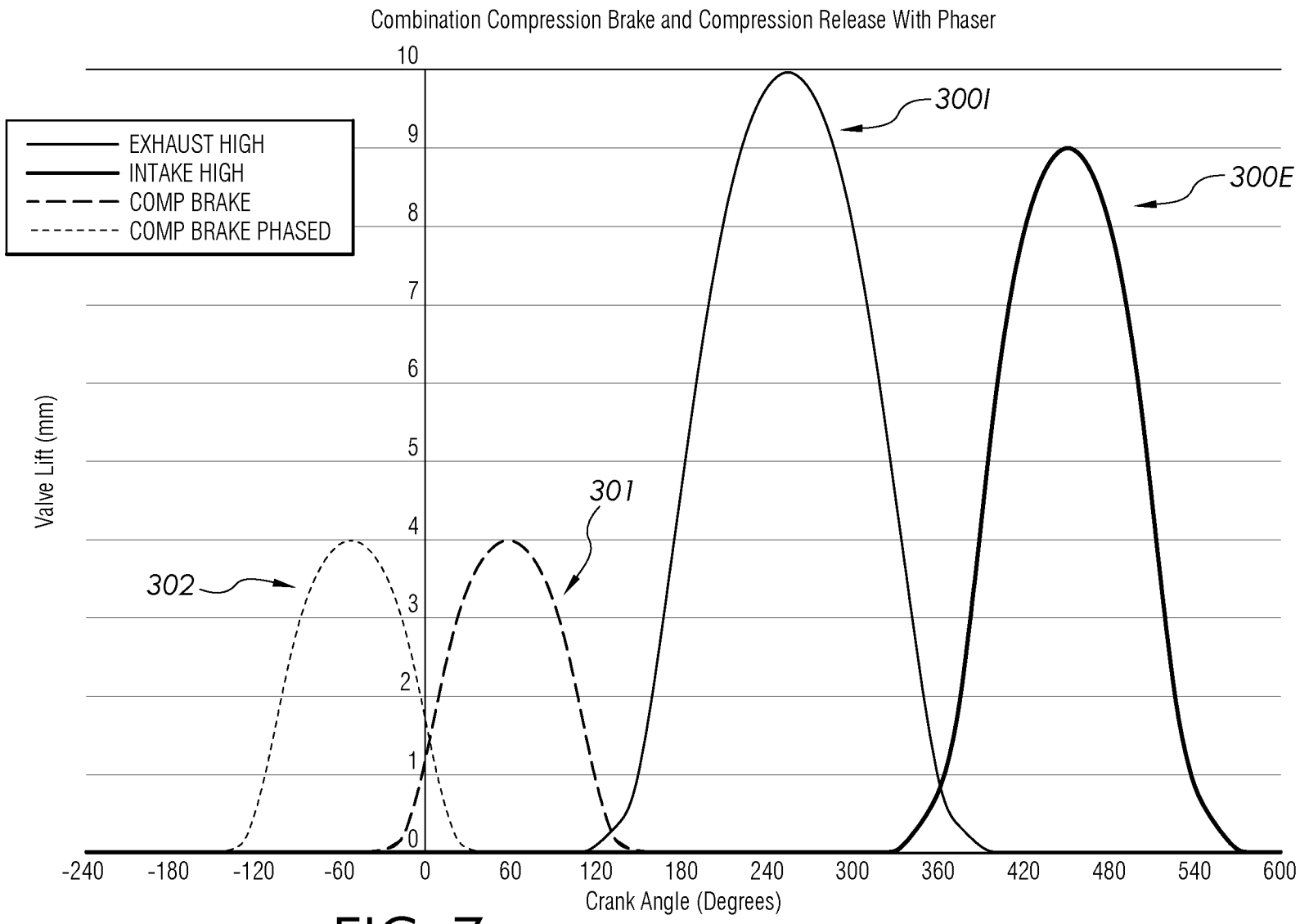
FIG. 7 is a graph of nominal lift profiles and compression brake profiles.

Switching tappet 100 can be employed in a type-1 valvetrain (DOHC with direct-acting tappet) that operates the intake and exhaust valves 22, 24 via a camshaft having a number of cam lobes. In certain embodiments, switching tappet 100 is a bucket type tappet that includes an inner bucket shaped member 104 that is surrounded by an outer member 106. The switching tappet 100 also includes a contoured contact surface 102 defined in part by the inner member 104 and outer member 106 so that at least a part of the contact surface 102 maintains a sliding contact with one or more cam lobes and opens the respective valve 22, 24 according to the lift profile via a direct tappet-valve surface contact. To implement compression braking with switching tappet 100, the system is required to actuate an additional lift profile (corresponding to a compression brake) as and when required during engine operation, such as shown in FIG. 6E. To implement a compression brake event with switching tappet 100, the system is required to actuate an additional lift profile 301 (corresponding to a compression brake) as and when required during engine operation, such as shown in FIG. 7. FIG. 7 illustrates an exemplary nominal intake valve lift profile 3001 and an exemplary nominal exhaust valve lift profile 300E.

In one embodiment, switching tappet 100 is implemented in a VA system 90 that provides variable valve lift (VVL). For VVL, each valve is served by three cam lobes where the center cam lobe has lower lift and shorter duration and the outer two are identical with higher lift and longer duration. The switching tappet 100 includes inner tappet 104 for contacting the center cam lobe and a concentric outer ring-shaped tappet 106 for contacting the outer two cam lobes. Inner tappet 104 can be locked together with outer tappet 106 by a locking mechanism such as a hydraulically operated locking pin 108.

Figure 5:
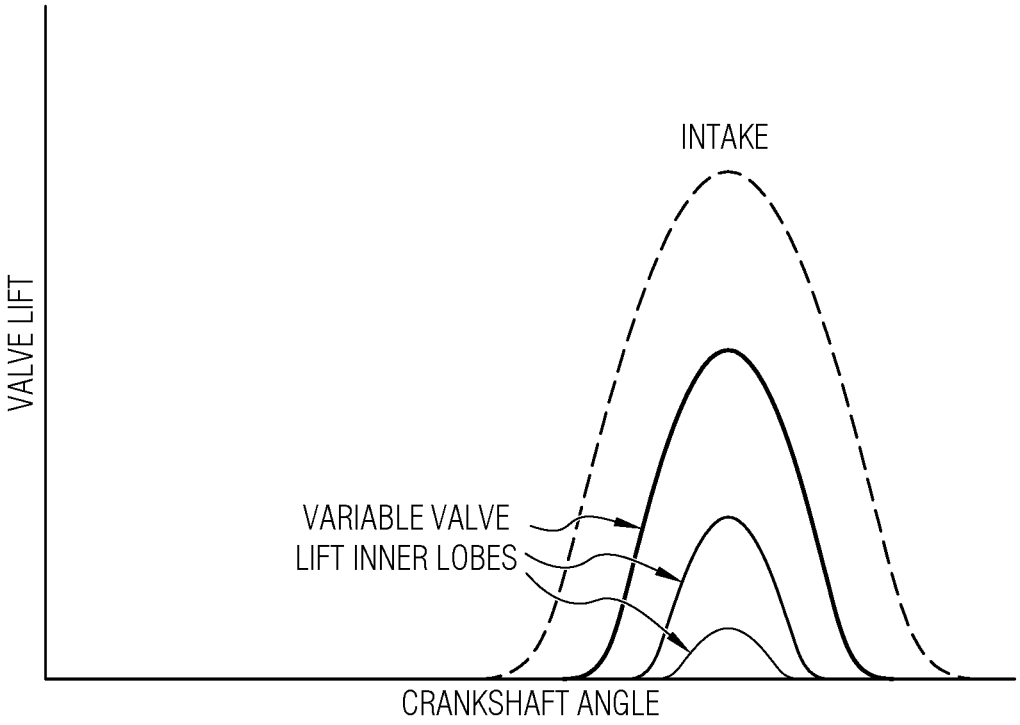
FIG. 5 is a graph showing a relationship between crank angle and intake and exhaust valve lift profiles for a variable valve lift cam lobe.

The selection of the cam lobe against which the switching tappet 100 acts during engine operation is made by the controller 80. Controller 80 is configured to provide a command to activate the hydraulic locking pin 108 to engage the outer tappet 106 with inner tappet 104 and in turn, the higher lift profile cam lobe, as and when required. The inner tappet 104 moves freely under the shadow of the outer tappet's 106 higher lift profile. When the tappets 104, 106 are not locked together, the exhaust valve 24 is actuated by the low cam lobe via the inner tappet 104 and the outer tappet 106 moves independently of the valve motion (FIG. 5). This configuration can also be used to implement cylinder de-activation (CDA) by just reducing the inner cam lobe profile to the base circle so that zero lift is achieved via the inner tappet 104 when CDA is activated.

To achieve compression braking with switching tappet 100, the lower braking lift profile is to be pushed out of the shadow of the higher nominal lift profile, as shown in FIG. 5 and FIGS. 6A-6E. This is a result of the performance requirement to release compressed air in the cylinder 14 just as the compression stroke ends. Hence, during compression release engine braking, the exhaust valve 24 is required to operate on both lift profiles (nominal and compression release). Since, the switching tappet 100 limits the switching option to only the outer tappet 106, the engine braking lift profile is placed on the outer lobes of the cam in contact with outer tappet 106. The inner cam lobe is always engaged with the inner tappet 104 to satisfy the exhaust lift event requirements.

When the braking command is received, controller 80 activates the hydraulic locking pin 108 which locks the outer tappet 106 and the inner tappet 104. Thus, during the braking mode, both cam lobes would be engaged with the valve through switching tappet 100 thereby obtaining the desired valve lift profiles for compression braking and compression release.

FIG. 7 also illustrates an exemplary compression braking profile 301 for operation of exhaust valve(s) 24. Also illustrated is a nominal lift profile, such as for example, nominal lift profiles 300E and 3001 shown in FIG. 7. As discussed above, the switching tappet 100 can be employed in a type-1 valvetrain or the VA system 90 and is based on a compression brake and compression release valve profile, such as, for example, shown in FIG. 7. Alternatively, the compression brake is achieved in one embodiment by the use of the profile switching valvetrain. The compression brake profile is offset significantly from the normal exhaust profile and has a shorter peak lift. The compression brake profile is shifted such that it starts to open shortly around TDC of the compression stroke or TDC of the power stroke (fuel or no fuel). This same profile may be used in combination with a cam phaser to move the profile to a compression stroke side of TDC to provide a compression release function. One example of the cam phaser is a gear system attached to the internal combustion engine 12 that is configured to adjust the cam shaft position while the engine is running wherein the cam phaser is operably controlled by the controller 80. Due to the short peak lift of the exhaust brake profile, piston and head design may be made to accommodate this lift profile at peak lift at TDC. If the crank angle is less than zero degrees, then the cam phaser reduces the compression event and reduces the power required to start engine 12. If the crank angle is greater than zero degrees, then more power is sent to the engine 12 and a compression braking event occurs.

During operation of the internal combustion engine system 10, the controller 80 can receive information from the various sensors listed above through I/O interface(s), process the received information using a processor based on an algorithm stored in a memory of the controller 80, and then send command signals to the various actuators through the I/O interface. For example, the controller 80 can receive information regarding an engine braking request, a vehicle or engine speed request, and/or one or more temperature inputs regarding a thermal management condition. The controller 80 is configured to process the requests and/or temperature input(s), and then based on the control strategy, send one or more command signals to one or more actuators to provide engine braking locking tappets 104, 106 to one another and modulate an opening/closing timing of the exhaust valve(s) 24 using the associated engine braking cam lobe(s).

The controller 80 can be configured to implement the disclosed combustion and thermal management strategies using VA system 90 and fuel system 30. In one embodiment, the disclosed method and/or controller configuration include the controller 80 providing an engine braking command in response to an engine braking request that is based on one or more signals from one or more of the plurality of sensors described above for internal combustion engine system 10. The engine braking command controls VA mechanism 90 to provide a braking power with the engine 12 at a given engine speed by modulating a timing of at least one of an exhaust valve opening and an exhaust valve closing during a compression stroke of the piston(s) 16 of engine 12.

The control procedures implemented by the controller 80 can be executed by a processor of controller 80 executing program instructions (algorithms) stored in the memory of the controller 80. The descriptions herein can be implemented with internal combustion engine system 10. In certain embodiments, the internal combustion engine system 10 further includes a controller 80 structured or configured to perform certain operations to control internal combustion engine system 10 in achieving one or more target conditions. In certain embodiments, the controller forms a portion of a processing subsystem including one or more computing devices having memory, processing, and communication hardware. The controller may be a single device or a distributed device, and the functions of the controller 80 may be performed by hardware and/or by instructions encoded on a computer readable medium.

In certain embodiments, the controller 80 includes one or more modules structured to functionally execute the operations of the controller. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on a non-transient computer readable storage medium, and modules may be distributed across various hardware or other computer components.

Certain operations described herein include operations to interpret or determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a non-transient computer readable storage medium, receiving the value as a run-time parameter by any means known in the art, and/or by receiving a value by which the interpreted or determined parameter can be calculated, and/or by referencing a default value that is interpreted or determined to be the parameter value.

Figure 8:
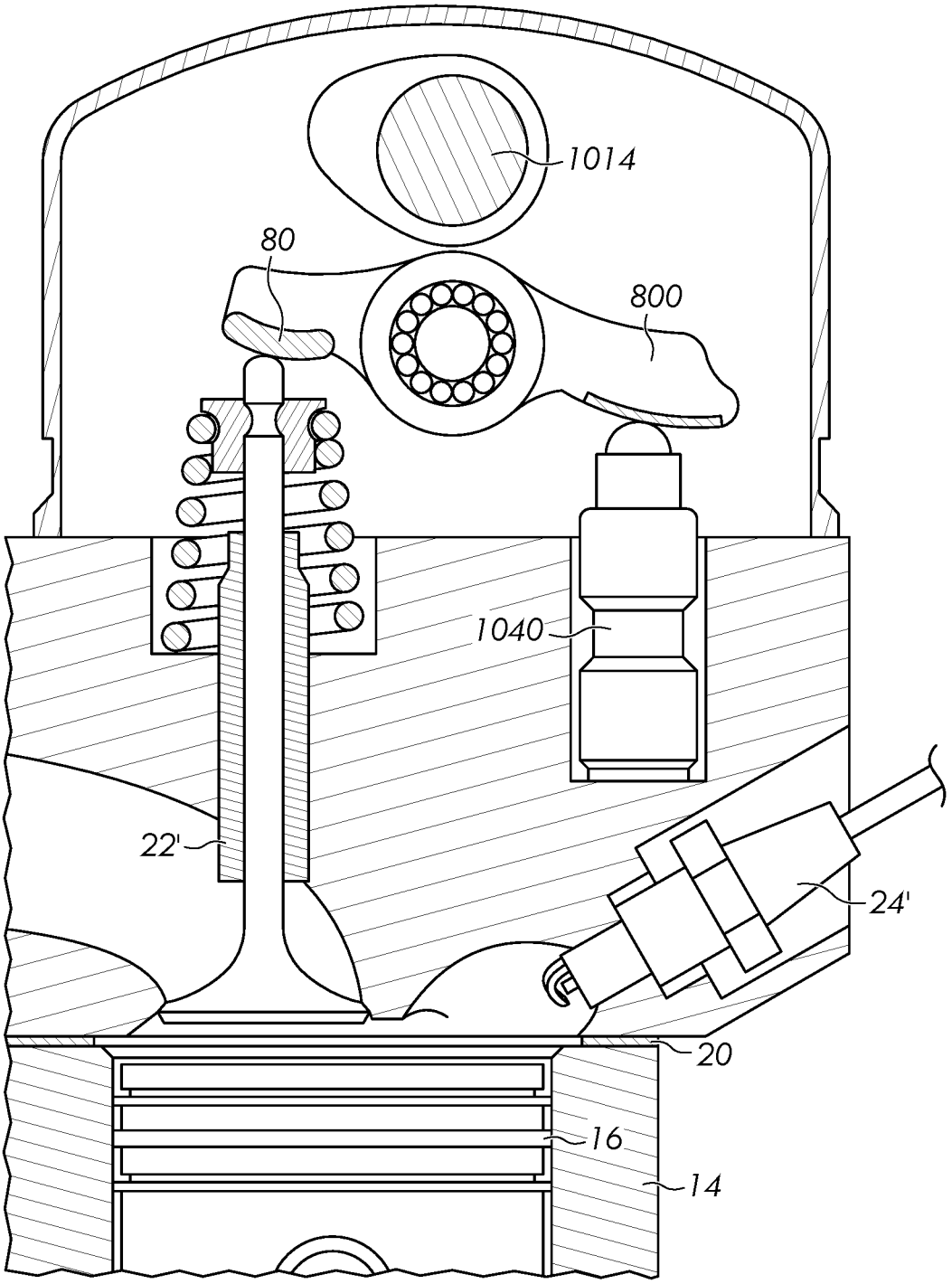
FIG. 8 is a diagrammatic and schematic view of a second embodiment of a cylinder of the internal combustion engine system of FIG. 1 and a schematic of a second embodiment of a roller finger follower.
Figure 9:
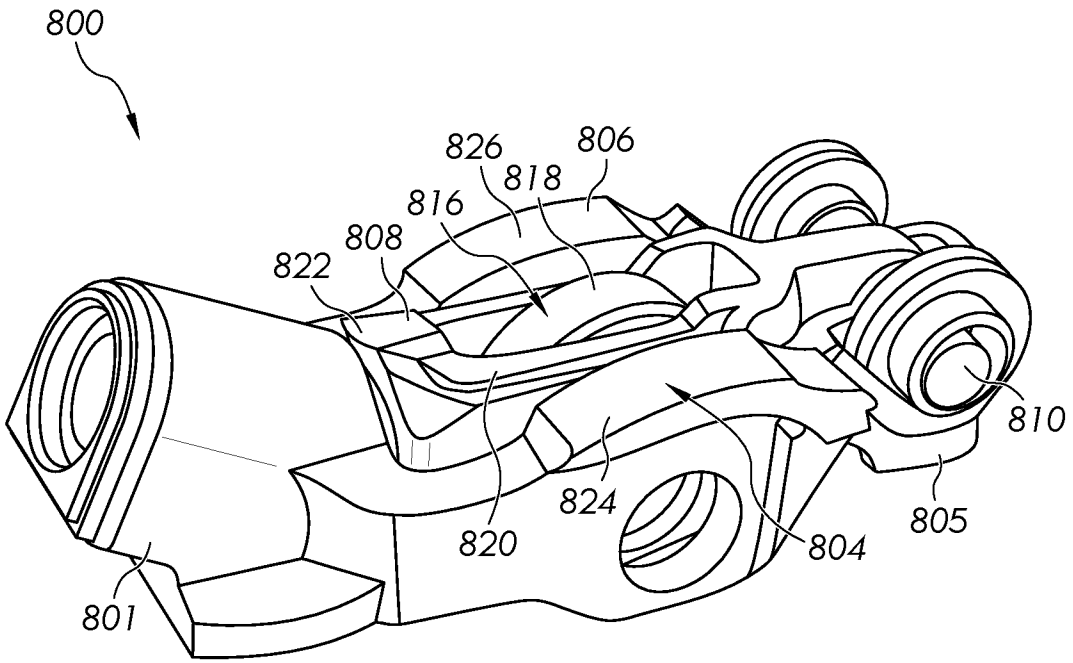
FIG. 9 is a perspective view of the roller finger follower from FIG. 8.
Figure 10:
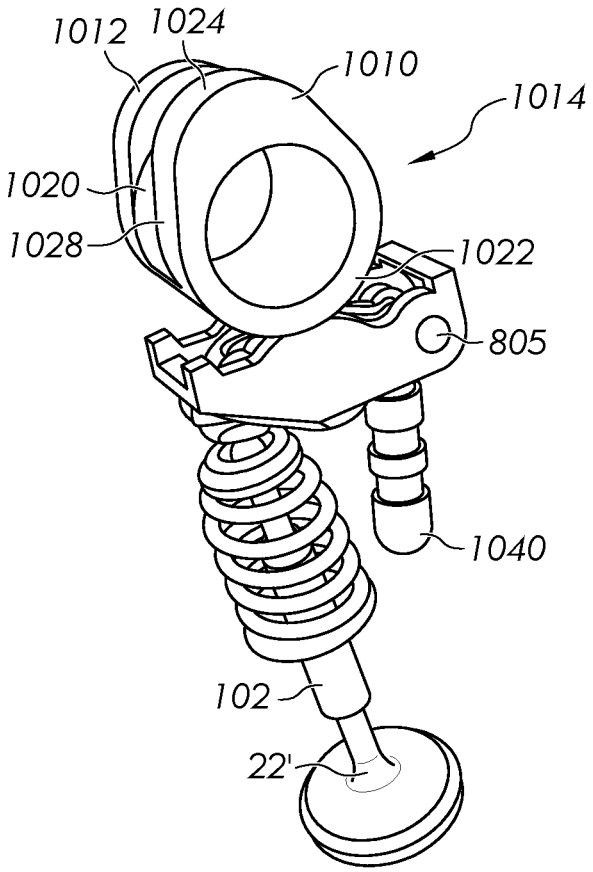
FIG. 10 is a perspective view of the roller finger follower from FIG. 8.

The present disclosure is also applicable to a type-2 roller finger follower system or roller finger follower 800 utilized with an internal combustion engine system 10' as illustrated in FIGS. 8, 9, and 10. The internal combustion engine system 10' is similar to the internal combustion engine system 10 from FIG. 1 in all aspects unless noted otherwise. The internal combustion engine system 10' includes an intake valve 22' similar to intake valve 22 from FIG. 1, and an exhaust valve 24' similar to exhaust valve 24. The roller finger follower 800 is utilized with a cam 1014 that includes one or more cam lobes that are in contact with the roller finger follower 800 as described in more detail below.

The roller finger follower 800 actuates intake and exhaust valves and provides for service needs, variable valve lift (VVL) or cylinder deactivation (CDA), and compression release brake needs. VVL and cylinder deactivation functionality is achieved in the type-2 roller finger follower system 800 with the use of a hydraulically operated pin or other locking mechanism. FIGS. 8, 9, and 10 illustrate an exemplary type-2 roller finger follower 800 by way of example only and it will be appreciated that the configuration of the roller finger follower 800 is not limited to the configuration illustrated.

The roller finger follower 800 includes an outer sliding follower 803 and an inner roller follower arm 808 operatively connected by a hydraulic locking pin 810. The outer sliding follower 803 includes a first outer arm or first outer sliding follower 804 opposite a second outer arm or second outer sliding follower 806. In an assembled configuration, the inner roller follower arm 808 is sandwiched or disposed between the first and second outer sliding followers 804 and 806. The first outer sliding follower 804, the second outer sliding follower 806, and the inner roller follower arm 808 are assembled together at a pivot axle (not illustrated). The pivot axle allows a rotational degree of freedom pivoting about the axle when the roller finger follower 800 is in a deactivated state.

The inner roller follower arm 808 includes a bearing 816 that includes a roller 818 that is mounted between a first inner side arm 820 and a second inner side arm 822 on a bearing axle (not illustrated) that during normal operation of the roller finger follower 800, serves to transfer energy from a rotating cam (not illustrated) to the roller finger follower 800. Mounting the roller 818 on the bearing axle allows the bearing 816 to rotate about the bearing axle, which serves to reduce the friction generated by the contact of the rotating cam with the roller 818. As discussed herein, the roller 818 is rotatably secured to the first and second inner side arms 820 and 822, which in turn may rotate relative to the first and second outer arms 804 and 806 about the pivot axle 812 under certain conditions.

As shown in FIG. 10, an intake valve 22' is also in contact with the roller finger follower 800 near its first end 801, and thus the reduced mass at the first end 101 of the roller finger follower 800 reduces the mass of the overall valve train (not shown), thereby reducing the force necessary to change the velocity of the valve train.

With continued reference to FIG. 9, the first outer arm 804 has a first lobe contacting surface 824 and the second outer arm 806 has a second lobe contacting surface 826. The first and second lobe contacting surfaces 824, 826 are configured to come into contact with a first and a second cam lobe 1010, 1012 of a cam 1014, as described in more detail below.

The mechanism for selectively deactivating the roller finger follower 800 is the hydraulic locking pin 810. The hydraulic locking pin 810 is operated by the controller 80 that is configured to provide a command to activate the hydraulic locking pin 810 to engage the outer sliding follower 803 and in turn, a higher lift profile, as and when required. The inner roller follower arm 808 moves freely as its lift under the shadow of the outer sliding follower 803 higher lift profile. When the outer sliding follower 803 is not locked with the inner roller follower arm 808, the valve is actuated by the low cam lobe via the inner roller follower arm 808 and the outer sliding follower 803 that move independent of the valve motion. This configuration can be used to implement CDA by reducing the outer cam lobe profile to the base circle or removing the outer lobes altogether so that zero lift is achieved via the outer sliding follower 803 when CDA is activated.

FIG. 10 illustrates a perspective front view of the roller finger follower 800 in relation to the cam 1014 having a center lift lobe 1020 configured to engage the inner roller follower arm 808. The center lift lobe 1020 has a lower lift and shorter duration than the first and second cam lobes 1010, 1012. The first and second cam lobes 1010, 1012 are identical to each other and have a higher lift and longer duration as compared to the center lift lobe 1020. The first and second cam lobes 1010, 1012 each include a base circle 1022 and a lifting portion 1024 positioned above the first and second lobe contacting surfaces 824, 826. The center lift lobe 1020 includes a base circle 1028 having a diameter that corresponds to the diameter of the base circle 1022. It should be noted that the diameter of the base circle 1028 need not be identical to the diameter of the base circle 1022, but may have a diameter equal to, smaller, or larger than the diameter of the base circle 1022. In other embodiments, the first and second cam lobes 1010, 1012 and the center lift lobe 1020 may be configured differently.

FIGS. 8 and 10 illustrate the roller finger follower 800 assembled with the cam 1014. A lash adjuster 1040 engages the roller finger follower 800 adjacent its second end 805, and applies upward pressure to the roller finger follower 800, and in particular the outer sliding follower 803, while mitigating against valve lash. The valve stem 1002 engages the first end 801 of the roller finger follower 800. In the activated state, the roller finger follower 800 periodically pushes the valve stem 102 downward, which serves to open the intake valve 22'.

During engine operation the selection of the cam lobe against which the roller finger follower 800 acts is made by the controller 80. Controller 80 is configured to provide a command to activate the hydraulic locking pin 810 to engage the outer sliding follower 803 and in turn the higher lift profile cam lobe or the first and second cam lobes 1010, 1012, as and when required. The inner roller follower arm 808 moves freely as its lift under the shadow of the outer sliding follower 803 higher lift profile. When the inner roller follower arm 808 and the outer sliding follower 803 are not locked together, the exhaust valve 24' is actuated by the low cam lobe via the inner roller follower arm 808, and the outer sliding follower 803 moves independently of the valve motion (FIG. 5). This configuration can also be used to implement cylinder de-activation (CDA) by just reducing the outer cam lobe profile to the base circle or removing the outer lobes altogether so that zero lift is achieved via the outer sliding follower 803 when CDA is activated.

To achieve compression braking with the roller finger follower 800, the lower braking profile is desired to be pushed out of the shadow of the higher nominal lift profile, as shown in FIG. 5 and FIGS. 6A-6E. This is a result of the performance requirement to release compressed air in the cylinder 14 just as the compression stroke ends. Hence, during compression release engine braking, the exhaust valve 24' is required to operate on both lift profiles (nominal and compression release). Since, the roller finger follower 800 limits the switching option to only the outer sliding follower 803, the braking lift profile would be placed on the outer lobes or the first and second cam lobes 1010, 1012 of the cam 1014. The inner cam lobe or the center lift lobe 1020 would always remain engaged with the exhaust valve 24' via the inner roller follower arm 808 to satisfy the exhaust lift event requirements.

When the braking command is received, the controller 80 activates the hydraulic locking pin 810 which locks the outer sliding follower 803 with the inner roller follower arm 808. Thus, during the braking mode, both cam lobes would be engaged with the valve through the outer sliding follower 803 and the inner roller follower arm 808 thereby obtaining the desired valve lift profiles for compression braking and compression release.

As discussed above, FIG. 7 illustrates an exemplary compression braking profile 301 for operation of exhaust valve(s) 24, and a nominal lift profile, such as for example, nominal lift profiles 300E and 3001. The roller finger follower 800 can be employed in a type-2 valvetrain and operable with a compression brake and compression release valve profile, such as, for example, shown in FIG. 7.

As discussed above, either the switching tappet 100 employed in a type-1 valvetrain or the roller finger follower 800 in a type-2 valvetrain can be used for a compression release event or a compression braking event. In either configuration, a default position for the type-1 and type-2 valvetrains is a compression release event.

Various aspects of the present disclosure are contemplated. According to one aspect, a method, comprising receiving a charge flow into a plurality of cylinders of an internal combustion engine system from an intake system; opening an exhaust valve of one of the plurality of cylinders during an exhaust stroke of the cylinder with an inner member of a switching tappet acting on a first cam lobe of a cam shaft connected to the switching tappet; and in response to an engine braking condition associated with the internal combustion engine, locking an outer member of the switching tappet to the inner member to open the exhaust valve during a compression stroke of the cylinder with the outer member of the switching tappet acting on a second cam lobe of the cam shaft.

According to another aspect the method includes the internal combustion engine system includes an exhaust system for receiving exhaust gas produced by combustion of a fuel provided to at least a portion of the plurality of cylinders from a fueling system, and at least one turbine and at least one aftertreatment device in the exhaust system.

According to another aspect the method includes each of the plurality of cylinders is connected to a respective one of a plurality of switching tappets.

According to another aspect the method includes the outer tappet extends around and houses the inner tappet.

According to another aspect the method includes locking the outer member to the inner member includes hydraulically actuating a locking pin in one of the inner and outer members to extend between the inner and outer members.

According to another aspect the method includes in response to a compression release condition associated with the internal combustion engine, using a cam phaser to move the compression braking profile to provide a compression release condition.

According to another aspect the method includes a default position of the cam phaser is the compression release condition.

According to another aspect a system, comprising an internal combustion engine including a plurality of cylinders that receive a charge flow from an intake system for combustion of a fuel provided to at least a portion of the plurality of cylinders; at least one sensor operable to provide signals indicating operating conditions of the system; a valve actuation mechanism configured to control an opening and closing timing of exhaust valves associated with the plurality of cylinders, wherein the valve actuation mechanism includes a switching tappet associated with an exhaust valve of each of the plurality of cylinders, the switching tappet including an inner tappet in contact with a first cam lobe configured to open the exhaust valve during an exhaust stroke of the associated cylinder; and a controller connected to the at least one sensor operable to interpret one or more signals from the at least one sensor, wherein the controller, in response to an engine braking request based on the one or more signals, is configured to control the valve actuation mechanism to lock the inner member of the switching tappet with an outer member of the switching tappet, the outer member in contact with a second cam lobe configured to open the exhaust valve during a compression stroke of the associated cylinder.

According to another aspect the system includes the outer member extends around the inner member and the inner member is bucket shaped.

According to another aspect the system includes the switching tappet includes a locking pin housed in one of the inner and outer members so that the inner and outer members are movable relative to one another and the locking pin is hydraulically actuated to extend between and lock the inner and outer members to one another during engine braking.

According to another aspect the system includes the outer member includes a cylindrical body that houses the inner member therein.

According to another aspect the system includes the inner member moves independently of the outer member during the exhaust stroke of the cylinder.

According to another aspect the system includes a cam phaser operably connected to the internal combustion engine; wherein the controller, in response to a compression release condition based on the one or more signals, is configured to lock the cam phaser in a compression release condition.

According to yet another aspect a system comprising an internal combustion engine including a plurality of cylinders that receive a charge flow from an intake system for combustion of a fuel provided to at least a portion of the plurality of cylinders; at least one sensor operable to provide signals indicating operating conditions of the system; a roller finger follower configured to control an opening and closing timing of exhaust valves associated with the plurality of cylinders, the roller finger follower having an inner roller follower arm disposed adjacent an outer sliding follower; and a controller connected to the at least one sensor operable to interpret one or more signals from the at least one sensor, wherein the controller, in response to an engine braking request based on the one or more signals, is configured to control the roller finger follower to lock the inner roller follower arm of the roller finger follower with the outer sliding follower of the roller finger follower, the outer sliding follower in contact with a second cam lobe configured to open the exhaust valve during a compression stroke of the associated cylinder.

According to another aspect the system includes the inner roller follower arm is operatively connected to the outer sliding follower via a locking mechanism.

According to another aspect the system includes the internal combustion engine system includes an exhaust system for receiving exhaust gas produced by combustion of a fuel provided to at least a portion of the plurality of cylinders from a fueling system, and at least one turbine and at least one aftertreatment device in the exhaust system.

According to another aspect the system includes a cam phaser operably connected to the internal combustion engine; wherein the controller, in response to a compression release condition based on the one or more signals, is configured to lock the cam phaser in a compression release condition.

According to another aspect a method, comprises receiving a charge flow into a plurality of cylinders of an internal combustion engine system from an intake system, the internal combustion engine system including a valve actuation mechanism connected to each of the plurality of cylinders wherein the valve actuation mechanism includes an outer member lockable with an inner member to control an opening and closing timing of exhaust valves associated with the plurality of cylinders, receiving at least one signal from at least one sensor operably connected to a controller of the internal combustion engine system, the at least one signal indicating operating conditions of the system; operating the valve actuation mechanism having a compression release profile in response to a compression release condition associated with the internal combustion engine, the valve actuation mechanism locking the outer member to the inner member of the valve actuation mechanism to open the exhaust valve during a compression stroke of the cylinder with the outer member acting on a second cam lobe of the cam shaft and the inner member acting on a first cam lobe of the cam shaft; and locking a cam phaser operably connected to the internal combustion engine in a compression release condition.

According to another aspect the method includes operating the cam phaser in a default position that includes a compression release condition.

According to yet another aspect the method includes operating the valve actuation mechanism having a compression brake valve profile in response to a compression brake condition, the valve actuation mechanism locking the outer member to the inner member of the valve actuation mechanism to open the exhaust valve during a compression stroke of the cylinder with the outer member acting on a second cam lobe of the cam shaft and the inner member acting on a first cam lobe of the cam shaft.

According to yet another aspect the method includes in response to the compression brake condition, operating the cam phaser in an active position that includes a compression brake condition.

According to yet another aspect the method includes the valve actuation mechanism includes a roller finger follower.

According to yet another aspect the method includes the valve actuation mechanism includes a switching tappet.

According to yet another aspect the method includes the internal combustion engine system includes an exhaust system for receiving exhaust gas produced by combustion of a fuel provided to at least a portion of the plurality of cylinders from a fueling system, and at least one turbine and at least one aftertreatment device in the exhaust system.

According to yet another aspect the method includes locking the outer member to the inner member includes hydraulically actuating a locking pin in one of the inner and outer members to extend between the inner and outer members.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

receiving a charge flow into a plurality of cylinders of an internal combustion engine system from an intake system;

opening an exhaust valve of a first cylinder of the plurality of cylinders during an exhaust stroke of the first cylinder when a first cam lobe of a cam shaft acts on an inner member of a switching tappet; and in response to an engine braking condition associated with the internal combustion engine system, locking an outer member of the switching tappet to the inner member so as to open the exhaust valve during a compression stroke of the first cylinder when a second cam lobe of the cam shaft acts on the outer member.

2. The method of claim 1, wherein the internal combustion engine system includes an exhaust system configured to receive exhaust gas produced by combustion of a fuel provided to at least a portion of the plurality of cylinders from a fueling system, the exhaust system including at least one turbine and at least one aftertreatment device.

3. The method of claim 1, wherein each of the plurality of cylinders is connected to a respective one of a plurality of switching tappets.

4. The method of claim 1, wherein the outer member extends around and houses the inner member.

5. The method of claim 1, wherein the locking of the outer member to the inner member includes hydraulically actuating a locking pin in one of the inner and outer members so as to extend between the inner and outer members.

6. The method of claim 1, further comprising:

in response to a compression release condition associated with the internal combustion engine, using a cam phaser to rotate a compression braking profile of the second cam lobe so as to provide a compression release event.

7. The method of claim 6, wherein a default position of the cam phaser is configured to provide the compression release event.

8. A system, comprising:

an internal combustion engine including a plurality of cylinders that receive a charge flow from an intake system so as to combust a fuel provided to at least a portion of the plurality of cylinders;

at least one sensor operable to provide one or more signals indicating operating conditions of the system;

a valve actuation mechanism configured to control an opening and closing timing of exhaust valves associated with the plurality of cylinders, the valve actuation mechanism including a plurality of switching tappets respectively associated with an exhaust valve of each cylinder, each switching tappet including an inner member in contact with a first cam lobe configured to open the exhaust valve during an exhaust stroke of an associated cylinder of the plurality of cylinders, and an outer member in contact with a second cam lobe configured to open the exhaust valve during a compression stroke of the associated cylinder; and a controller connected to the at least one sensor and operable to interpret the one or more signals, wherein, in response to an engine braking request based on the one or more signals, the controller is configured to control the valve actuation mechanism so as to lock the inner member with the outer member.

9. The system of claim 8, wherein the outer member extends around the inner member and the inner member is bucket shaped.

10. The system of claim 8, wherein each switching tappet further includes a locking pin housed in one of the inner and outer members, and wherein the inner and outer members are normally movable relative to one another, and the inner member is locked with the outer member when the locking pin is hydraulically actuated so as to extend between the inner and outer members during engine braking.

11. The system of claim 10, wherein the outer member includes a cylindrical body that houses the inner member.

12. The system of claim 8, wherein the inner member moves independently of the outer member during the exhaust stroke.

13. The system of claim 8, further comprising:

a cam phaser operably connected to the internal combustion engine;

wherein, in response to a compression release condition based on the one or more signals, the controller is configured to control the cam phaser so as to rotate a compression braking profile of the second cam lobe configured to provide a compression release event.

14. A method, comprising:

receiving a charge flow into a plurality of cylinders of an internal combustion engine system from an intake system, the internal combustion engine system including a valve actuation mechanism, wherein the valve actuation mechanism includes a plurality of switching tappets respectively associated with the plurality of cylinders, each switching tappet comprising an outer member and an inner member selectively locked to each other so as to control an opening and closing timing of an exhaust valve of an associated cylinder of the plurality of cylinders;

receiving at least one signal from at least one sensor operably connected to a controller of the internal combustion engine system, the at least one signal indicating operating conditions of the internal combustion engine system;

actuating each switching tappet with a compression release profile in response to a compression release condition associated with the internal combustion engine system such that the outer member is locked to the inner member so as to open the exhaust valve during a compression stroke of the associated cylinder when a first cam lobe of a cam shaft acts on the inner member and a second cam lobe of the cam shaft acts on the outer member; and locking a cam phaser operably connected to the internal combustion engine system so as to provide compression release event.

15. The method of claim 14, further comprising:

operating the cam phaser in a default position that is configured to provide the compression release event.

16. The method of claim 14, further comprising:

actuating each switching tappet with a compression brake valve profile in response to a compression brake condition such that the outer member is locked to the inner member so as to open the exhaust valve during the compression stroke when the first cam lobe acts on the inner member and the second cam lobe acts on the outer member.

17. The method of claim 16, wherein in response to the compression brake condition, operating the cam phaser in an active position configured to provide a compression brake event.

18. The method of claim 14, wherein the internal combustion engine system further includes an exhaust system configured to receive exhaust gas produced by combustion of a fuel provided to at least a portion of the plurality of cylinders from a fueling system, the exhaust system including at least one turbine and at least one aftertreatment device.

19. The method of claim 14, wherein the locking of the outer member to the inner member includes hydraulically actuating a locking pin in one of the inner and outer members so as to extend between the inner and outer members.

* * * * *